US006217458B1

(12) United States Patent
Armstrong, III et al.

(10) Patent No.: US 6,217,458 B1
(45) Date of Patent: Apr. 17, 2001

(54) GOLF GAME WITH A THREE DIMENSIONAL TARGET

(75) Inventors: Walter E. Armstrong, III, Maitland; Terrence P. Anton, Valrico, both of FL (US)

(73) Assignee: Snag, Inc., Lakeland, FL (US)

( * ) Notice: Subject to any disclaimer, the term of this patent is extended or adjusted under 35 U.S.C. 154(b) by 0 days.

(21) Appl. No.: 09/280,406

(22) Filed: Mar. 29, 1999

(51) Int. Cl.[7] ..... A63B 69/36
(52) U.S. Cl. ..... 473/193; 473/165; 473/172
(58) Field of Search ..... 473/173–181, 473/185, 186, 193, 165

(56) References Cited

U.S. PATENT DOCUMENTS

| | | | | |
|---|---|---|---|---|
| 2,635,879 | * | 4/1953 | Rath | 473/180 |
| 3,048,405 | * | 8/1962 | McCaul | 473/180 |
| 3,891,221 | * | 6/1975 | Gordon | 473/193 |
| 4,201,384 | * | 5/1980 | Barber | 473/351 |
| 4,718,677 | | 1/1988 | Barnes . | |
| 5,538,253 | * | 7/1996 | Foster | 273/348.3 |
| 5,549,302 | * | 8/1996 | Lapsker et al. | 273/348.4 |
| 5,626,342 | | 5/1997 | Foster . | |
| 5,655,972 | * | 8/1997 | Heitzman | 473/193 |
| 5,692,963 | * | 12/1997 | Holcombe | 473/185 |
| 5,730,658 | | 3/1998 | Kurtz et al. . | |
| 5,742,942 | | 4/1998 | Sykes . | |
| 6,004,219 | * | 12/1999 | Peabody | 473/193 |

OTHER PUBLICATIONS

Selby Sports Target Golf (undated, but admitted to be prior art).

* cited by examiner

*Primary Examiner*—Mark S. Graham
(74) *Attorney, Agent, or Firm*—James H. Beusse, Esq.; Holland & Knight LLP

(57) ABSTRACT

A golf game with a three dimensional target that utilizes hook and loop material. The game includes a club, a ball, a mat, and a three dimensional target. The ball and the three dimensional target have a hook and loop material (commonly referred to as Velcro®) affixed to them such that when the ball comes in contact with the three dimensional target, the ball will remain in position on the three dimensional target. The three dimensional target commonly is a cylinder with a hook material attached. A padded cushion can additionally be placed between the three dimensional target and the hook and loop material to buffer the contact between the ball and the three dimensional target. The ball has a material of a loop type surrounding it such that it will stay in position on the target as it contacts the target.

15 Claims, 3 Drawing Sheets

GOLF GAME WITH A THREE DIMENSIONAL TARGET

BACKGROUND OF THE INVENTION

The present invention relates to a golf game, and more particularly to a golf game having a three dimensional target surrounded by a hook and loop material for engaging a ball also surrounded by a hook and loop material.

U.S. Pat. No. 5,538,253 issued to Foster describes a simulation golf game that uses a hook and loop material. The game includes a sheet of material that has the same texture as a conventional golf green, as well as a ball and a golf club. A patch of hook and loop material (commonly referred to as Velcro®) is attached to an area of the sheet and an additional patch of hook and loop material is attached to the ball. The object of the game is for the player to hit the ball so that it will roll on to the patch of hook and loop material on the sheet. When the ball does make contact with the patch of hook and loop material, the ball will become attached to that patch, and play of that hole is completed. This design, however, fails to provide a target that is three dimensional to aid the player in locating the target and hitting the target. Furthermore, this game is not designed to be used with in conjunction with an existing hole at a golf course.

What is needed, then, and not found in the prior art, is an improved golf game providing a three dimensional target and a ball, the golf game further having a means by which to affix the ball to the three dimensional target when the ball comes into contact with the three dimensional target.

SUMMARY OF THE INVENTION

The current invention is a game similar to the conventional game of golf. The game includes a three dimensional target, a hitting mat, a ball, and one or more clubs. The three dimensional target is preferably cylindrical, but can also be other conventional three dimensional shapes (such as a cone) as desired by the player. A sheet of hook and loop material, commonly referred to as Velcro®, is attached to the three dimensional target.

To play the game, the player hits the ball with the club in the direction of the three dimensional target. The object of the game is for the player to hit the ball so that it makes contact with the three dimensional target. The score is kept in the same manner as a conventional golf game, with the player counting each time that the ball is struck until the ball makes contact with the three dimensional target. The player who has the fewest strokes is the winner of the competition.

BRIEF DESCRIPTION OF THE DRAWINGS

The objects and advantages of the present invention will become more readily apparent to those ordinarily skilled in the art after reviewing the following detail description and accompanying drawings wherein.

DETAILED DESCRIPTION OF THE INVENTION

Figure 1:
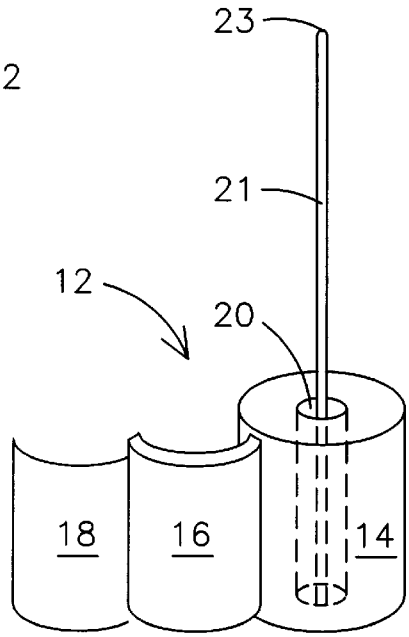
FIG. 1 is an expanded view of a three dimensional target of the golf game of the present invention.

Referring to FIG. 1, a game apparatus 10 includes a three dimensional target 12, one or more clubs 28, a mat 50 and a ball 30. To play the game with the above named elements, a player (not shown) places the ball 30 on the mat 50 and strikes the ball 30 with the club 28 in the direction of the three dimensional target 12. The player continues to hit the ball 30 with the club 28 until the ball 30 comes in contact with the three dimensional target 12. The player keeps score in a manner similar to the conventional game of golf, wherein each strike at the ball 30 counts as one stroke. Once the player causes the ball 30 to come in contact with the three dimensional target 12, the player has his score for that hole. In a competition with a number of players, the player with the lowest number of strokes for the designated number of holes (typically nine or eighteen) is the winner.

In the preferred embodiment, the three dimensional target 12 is a cylinder (as shown in FIGS. 1, 2, 3 and 4). Looking at FIG. 2*a*, the three dimensional target 12 typically has a base 14 and a target attachment material 18 surrounding the base 14 to form a receiving surface. The base 14 is preferably made of foam, but could also be made of other materials such as plastic. The target attachment material 18 is preferably one element of a hook and loop material, which is commonly sold under the trademark Velcro®. More specifically, the target attachment material 18 typically includes the hooks that interact with the loops of the hook and loop material.

Figure 2A:
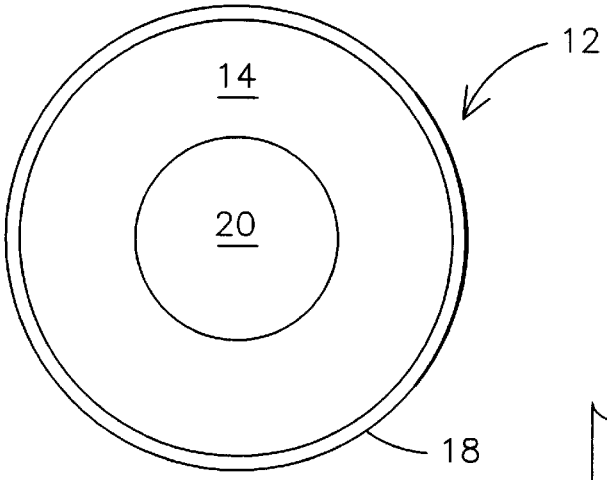
FIG. 2*a* is a top view of the three dimensional target of the present invention.
Figure 2B:
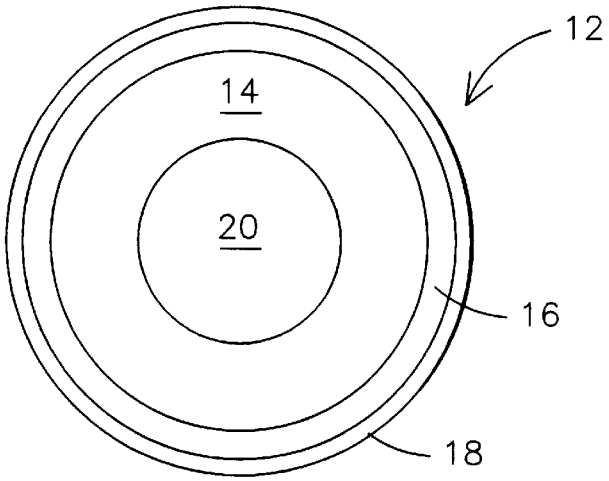
FIG. 2*b* is a top view of the three dimensional target of the present invention, with the three dimensional target including a cushion.

Additionally, looking at FIG. 2*b*, the three dimensional target 12 could include a cushion 16 fitted between the base 14 and the target attachment material 18. The cushion 16 is a pad typically made of a soft material, such as foam, so that the ball 30 will not bounce off of the three dimensional target 12 when the ball 30 makes contact with the three dimensional target 12. The cushion 16 is typically used when the base 14 is made of plastic or some other material having a hard surface.

Figure 5A:
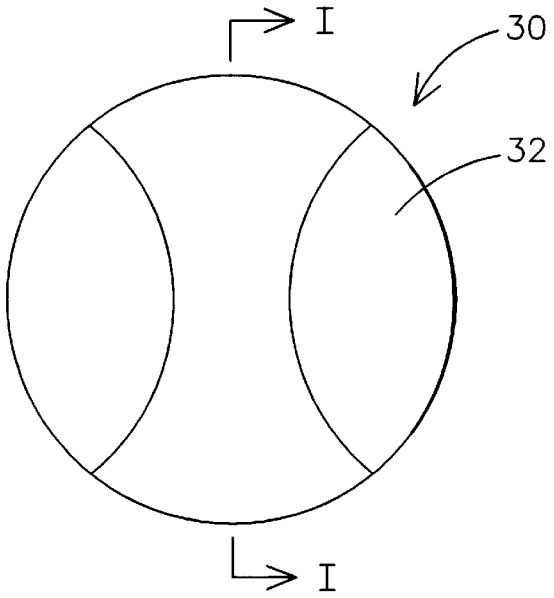
FIG. 5*a* is a side view of the ball of the golf game of the present invention.
Figure 5B:
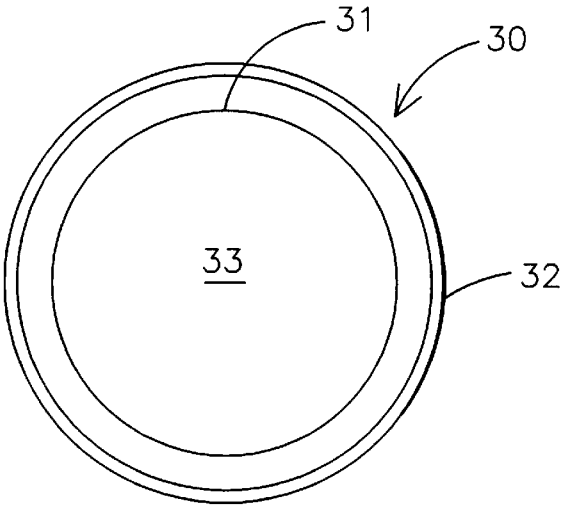
FIG. 5*b* is a section I—I view of the ball shown in FIG. 5*a*.

Looking at FIG. 5*a*, the ball 30 of the game apparatus 10 is typically slightly smaller than a conventional tennis ball (approximately 2.5 inches in diameter), although the size can be varied according to the choice of the player. Looking at FIG. 5*b*, the ball 30 is a rubber sphere 31 having a ball attachment material 32 affixed to the outside surface of the sphere 31. The sphere 31 encompasses a hollow area 33 which allows the ball to be compressed when forces are applied to the outside surface of the ball 30. Additionally, the approximate weight of the ball 30 is two ounces.

The ball attachment material 32 creates an engaging surface, and is the other element of the hook and loop material not used as the target attachment material 18. The ball attachment material 32 is chosen such that it will interact with the target attachment material 18. For example, if the target attachment material 18 includes the hooks, then the ball attachment material 32 will include the loops that interact with the hooks to secure the ball 30 to the three dimensional target 12. Therefore, when the ball 30 comes in contact with the three dimensional target 12, the ball 30 will stay affixed to the surface contacted.

Figure 6:
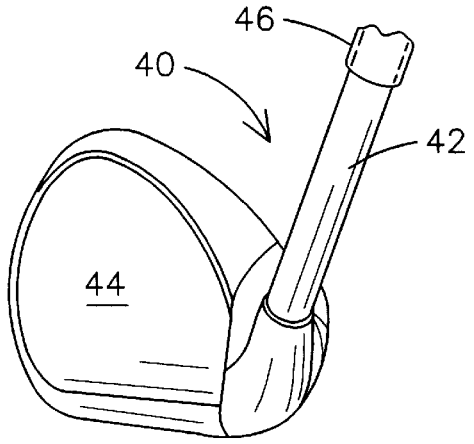
FIG. 6 is a plan view of one golf club of the golf game of the present invention.

The preferred embodiment of the game apparatus 10 further includes at least one club 40 to hit the ball 30, such as a conventional golf club (see FIG. 6). Each club 40 has a shaft 42 (typically made of fiberglass) connected to a head 44 and a rubber grip 46 surrounding a portion of the shaft 42. The player thereby holds the club 40 by the rubber grip 46 attached to the shaft 42 to hit the ball 30 with the head 44. The head 44 is typically made of a hard and smooth material such that it can contact the ball 30 and ball attachment material 32 without forming a bond with the ball attachment material 32 surrounding the ball 30.

Figure 7B:
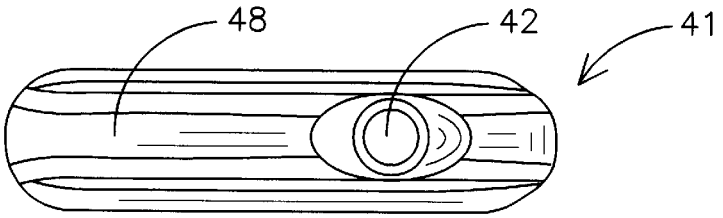
FIG. 7*b* is a top view of the second golf club of the golf game of the present invention.
Figure 7A:
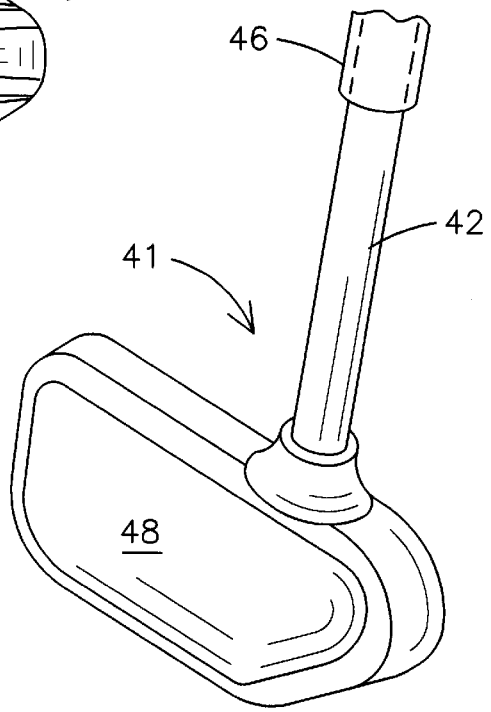
FIG. 7*a* is a plan view of a second golf club of the golf game of the present invention.

In the preferred embodiment, the game apparatus 10 includes two clubs: one club 40 having an angled head 44, such as a driver from a conventional set of golf clubs (see FIG. 6) and the other club 41 having a vertical head 48, such as a conventional putter golf club (see FIGS. 7*a* and 7*b*). The club 40 with the angled head 44 is therefore used to engage the ball 30 to lift and propel the ball 30 into the air so that it will travel a long distance towards the three dimensional target 12. The club 41 with the vertical head 44 is used to engage the ball 30 to roll the ball 30 a short distance towards the three dimensional target 12.

Figure 8A:
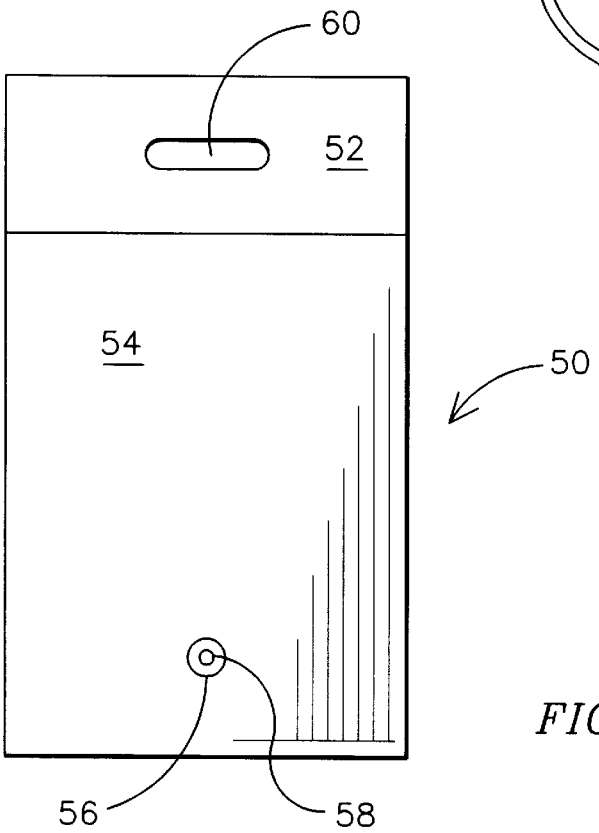
FIG. 8*a* is a top view of the mat used in the golf game of the present invention.
Figure 8B:
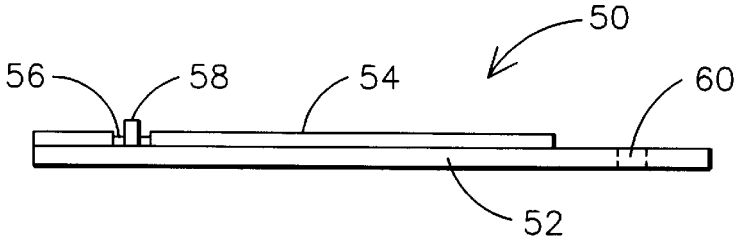
FIG. 8*b* is a side view of the mat used in the golf game of the present invention.

Looking at FIGS. 8*a* and 8*b*, the mat 50 of the preferred embodiment is includes a non-skid surface 52 and a turf layer 54. The non-skid surface 52 is typically made of rubber, and the turf layer 54 is made of an artificial turf material. The turf layer 54 is attached to the top of the non-skid surface 52 so that the player can stand on the mat 50 to hit the ball 30. Additionally, a tee hole 56 is located in the turf layer 54 through which a tee 58 is positioned. The tee 58 (which is typically made of rubber) is designed so that the ball 30 can be placed on it. The ball 30 can then be hit from the tee 58 or directly from the turf layer 54 of the mat 50. Furthermore, a handle 60 is an integrated part of mat 50. The handle 60 aids the player in transporting the mat 50 as needed.

Looking further at FIGS. 1, 2*a*, and 2*b*, the three dimensional target 12 includes a hollow core 20 that extends through the three dimensional target 12. There are various ways in which to securely position the three dimensional target 12 on the ground surface 26. One means for securing the three dimensional target 12 to the ground surface 26 is through using a rod 21 (shown in FIGS. 1, 3, and 4). This embodiment of the game apparatus 10 is designed so that the three dimensional target 12 can be placed around the rod 21 through the core 20. The rod 21 therefore provides two functions for the golf game apparatus 10. First, the rod 21 stabilizes the three dimensional target 12 at the location desired by the player. Second, the rod 21 also serves as a visual guide for the player to help the player determine the position of the three dimensional target 12 and how far it is away from the player.

Figure 3:
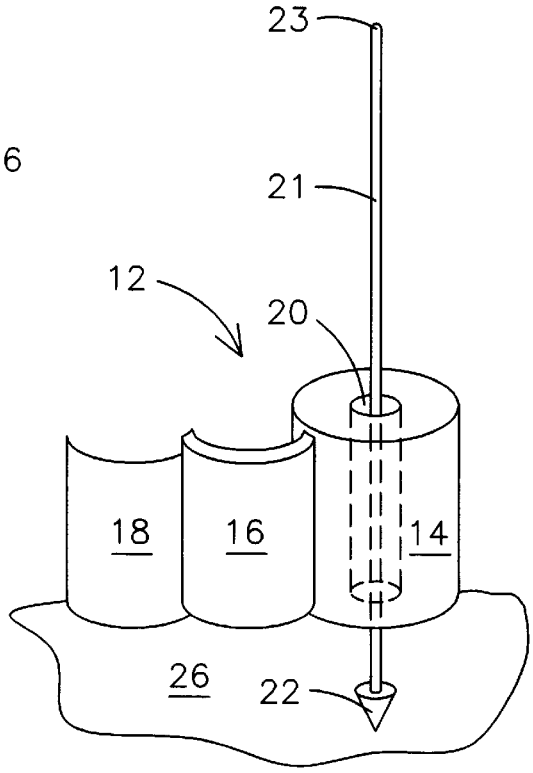
FIG. 3 is an expanded view of a second embodiment of the three dimensional target, whereby the three dimensional target includes a rod having a spiked end.

Looking further at FIG. 3, one embodiment of the rod 21 is shown to have a spiked end 22 and a blunt end 23. In this embodiment, the spiked end 22 of the rod 21 is designed so that it can be inserted into a ground surface 26 so as to secure the three dimensional target 12 to the ground 26. This design allows the player to be able to choose where the three dimensional target 12 will be located according to hardness of the surface 26 and according to the desires of the players.

Figure 4:
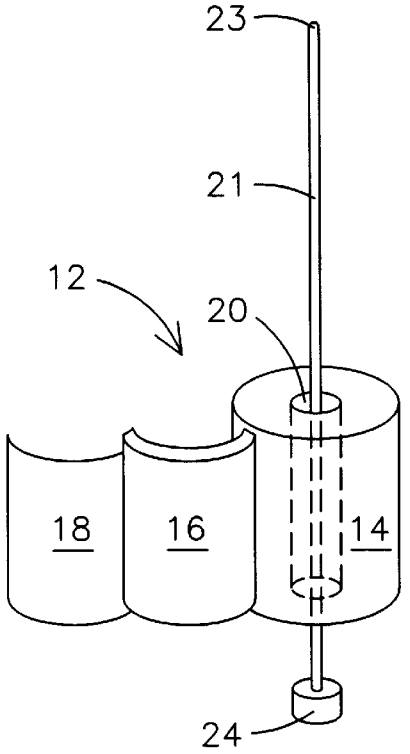
FIG. 4 is an expanded view of a third embodiment of the three dimensional target, whereby the three dimensional target includes a rod having a cup-shaped end.

Looking at FIG. 4, a second embodiment of the rod 21 is shown to have a cup-shaped end 24 and a blunt end 23. In this embodiment, the cup-shaped end 24 of the rod 21 is designed to completely fit into a hole (not shown) used in a conventional golf course. The diameter of the cup-shaped end 24 is such that it fits snugly into the hole so that the rod 21 will make a secure connection with the hole. In this embodiment, the player is able to arrange the three dimensional target 12 in the position according to where an established hole is located on an existing golf course. Consequently, the player aims for the three dimensional target 12 positioned in the location of the existing hole, and is able to play a hole on an existing golf course with the knowledge of the preexisting dimensions of the golf course.

A third method to secure the three dimensional target 12 to the ground surface 26 is by adjusting the size and weight of the three dimensional target 12. The size of the three dimensional target 12 determines the stability of the three dimensional target 12 on the surface 26 upon which it is placed. Looking at the cylindrical three dimensional target 12 of FIG. 1, the diameter of the base 14 is sufficient such that the three dimensional target 12 is stable on a flat surface, and does not require a rod 21 for stability. However, if the diameter of the base 14 is smaller, the three dimensional target 12 would require the rod 21 in the core 20 to prevent the base 14 from being toppled when the ball 30 makes contact with the three dimensional target 12. Furthermore, the base 14 itself can be hollow such that the base 14 can be filled with a weighting material (not shown), such as water or sand, to provide weight to obtain additional stability for the three dimensional target 12 without using a rod 21.

The size of the three dimensional target 12 can be varied not only to increase stability of the three dimensional target 12, but to also change the difficulty of the game. For example, the smaller the three dimensional target 12, the more difficult it is for the player to contact the three dimensional target 12 with the ball 30. Conversely, the greater the diameter of the three dimensional target 12, the easier it is for the player to make contact with the three dimensional target 12.

Moreover, the three dimensional target 12 of the current invention is not required to be cylindrical in shape in order to play the game. Examples of alternative shapes of the three dimensional object 12 include a sphere, a cube, or a cone. The alternative shapes must be designed such that the three dimensional target 12 continues to have a base 14, a cushion 16, and a target attachment material 18, as directed above. Further, the three dimensional target 12 will continue to maintain a hollow core 20 through which a rod 21 is insertable for securing the three dimensional target 12.

The present invention has been described in connection with a preferred embodiment thereof, and it will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A golf game comprising:

a three dimensional target and a target attachment material, said target attachment material affixed to said three dimensional target, said target having a width and having a height substantially greater than said width;

a ball and a ball attachment material, said ball attachment material affixed to said ball, wherein said ball attachment material is constructed to stick to said target attachment material when said ball contacts said three dimensional target, the ball having a diameter substantially greater than a conventional golf ball;

a club for engaging said ball to propel said ball toward said three dimensional target;

a mat and tee assembly for supporting the ball on the tee prior to hitting the ball with the club; and a cushion, separate from the target attachment material, said cushion positioned between said three dimensional target and said target attachment material.

2. The golf game of claim 1 wherein one of the target attachment material and the ball attachment material has a plurality of hooks.

3. The golf game of claim 2 wherein the other of the target attachment material and the ball attachment material has a plurality of loops.

4. A golf game comprising:

a three dimensional target and a target attachment material, said target attachment material affixed to said three dimensional target, said target having a width and having a height substantially greater than said width;

a ball and a ball attachment material, said ball attachment material affixed to said ball, wherein said ball attachment material is constructed to stick to said target attachment material when said ball contacts said three dimensional target, the ball having a diameter substantially greater than a conventional golf ball;

a club for engaging said ball to propel said ball toward said three dimensional target;

a mat and tee assembly for supporting the ball on the tee prior to hitting the ball with the club;

a rod;

a hollow core extending through said three dimensional target;

said rod extending through said core to position said three dimensional target;

a hole in a ground surface for inserting said rod; and wherein said rod further comprises a blunt end and cup-shaped end, said cup-shaped end being inserted into said hole to secure said rod in said hole.

5. The golf game of claim 1 wherein said three dimensional target is made of foam.

6. The golf game of claim 1 wherein said three dimensional target is made of plastic.

7. A golf game comprising;

a three dimensional target and a target attachment material, said target attachment material affixed to said three dimensional target, said target having a width and having a height substantially greater than said width;

a ball and a ball attachment material, said ball attachment material affixed to said ball, wherein said ball attachment material is constructed to stick to said target attachment material when said ball contacts said three dimensional target, the ball having a diameter substantially greater than a conventional golf ball;

a club for engaging said ball to propel said ball toward said three dimensional target;

a mat and tee assembly for supporting the ball on the tee prior to hitting the ball with the club; and the target being a cylindrical target having a height substantially greater than a diameter thereof.

8. A game apparatus comprising:

a cylinder having a diameter and a height substantially greater than the diameter;

a target attachment material affixed to said cylinder;

a ball having a diameter of at least two inches;

a ball attachment material affixed to said ball, one of the target attachment material and ball attachment material including a plurality of hooks and the other including a plurality of loops, wherein said ball attachment material sticks to said target attachment material when said ball contacts said cylinder to position said ball on said cylinder; and a club for contacting said ball to propel said ball toward said cylinder.

9. The game apparatus of claim 8 further comprising:

a rod; and a hollow core extending through said cylinder;

said rod extending through said core.

10. The game apparatus of claim 9 wherein said rod comprises a first and second end, said second end being pointed for insertion into a ground surface.

11. The game apparatus of claim 9, in combination with a ground surface having a hole defined therein, the game apparatus further comprising:

said rod further including a first and second end;

a securing disc attached to said second end of said rod;

said securing disc attached to said rod being inserted into said hole to brace rod in said hole.

12. The game apparatus of claim 8 further comprising a pad separate from said target attachment material, said pad positioned between said cylinder and said target attachment material.

13. The game apparatus of claim 8 wherein said cylinder is made of foam.

14. The game apparatus of claim 8 wherein said cylinder is made of plastic.

15. The game apparatus of claim 8 further comprising a tee for supporting the ball.

* * * * *